US011455880B2

(12) United States Patent
Lifshitz et al.

(10) Patent No.: US 11,455,880 B2
(45) **Date of Patent: *Sep. 27, 2022**

(54) SYSTEM AND METHOD FOR AUTOMATICALLY DISARMING AN INTRUSION DETECTION SYSTEM

(71) Applicant: TYCO Fire & Security GMBH, Neuhausen am Rheinfall (CH)

(72) Inventors: Shai Lifshitz, Lapid (IL); Daniel Rettig, Kfar Saba (IL)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 0 days.

This patent is subject to a terminal disclaimer.

(21) Appl. No.: 16/935,017

(22) Filed: Jul. 21, 2020

(65) Prior Publication Data

US 2020/0349826 A1 Nov. 5, 2020

Related U.S. Application Data

(63) Continuation of application No. 16/418,594, filed on May 21, 2019, now Pat. No. 10,748,411, which is a (Continued)

(51) Int. Cl.
*G08B 19/00* (2006.01)
*G08B 25/00* (2006.01)

(Continued)

(52) U.S. Cl.
CPC ..... *G08B 25/008* (2013.01); *G08B 13/26* (2013.01); *G08B 13/00* (2013.01)

(58) Field of Classification Search
CPC ..... G08B 13/26; G08B 25/008; G08B 13/00; G08B 25/001; G08B 26/007; G08B 13/19;

(Continued)

(56) References Cited

U.S. PATENT DOCUMENTS 6,233,448 B1 5/2001 Alperovich et al.
6,791,451 B1 * 9/2004 Muise ..... G08B 25/10 340/10.1

(Continued)

FOREIGN PATENT DOCUMENTS

DE 19646091 A 5/1998
FR 3040817 A 3/2017

OTHER PUBLICATIONS

May 29, 2018 International Search Report and Written Opinion issued in International Patent Application No. PCT/IL2018/050298.

(Continued)

*Primary Examiner* — Daniel Previl
(74) *Attorney, Agent, or Firm* — ArentFox Schiff LLP

(57) ABSTRACT

A system for automatically disarming an intrusion detection system, the intrusion detection system protecting a premises and having an armed state and a disarmed state of operation, including an intrusion detection system state of operation ascertainer operable, responsive to receiving an indication of detection of an intrusion, for ascertaining whether the intrusion detection system is in the armed state; a registered mobile communicator proximity detector communicating with the intrusion detection system state of operation ascertainer and operable, responsive to ascertaining that the intrusion detection system is in the armed state of operation, for ascertaining whether at least registered mobile communicator is in a vicinity of the premises; and an automatic intrusion detection system disarmer communicating with the registered mobile communicator proximity detector and operable, responsive to the ascertaining that at least one registered mobile communicator is in the vicinity of the premises, for automatically disarming the intrusion detection system.

20 Claims, 3 Drawing Sheets

Related U.S. Application Data continuation of application No. 15/920,666, filed on Mar. 14, 2018, now Pat. No. 10,347,116.

(60) Provisional application No. 62/506,804, filed on May 16, 2017.

(51) Int. Cl.
*G08B 13/26* (2006.01)
*G08B 13/00* (2006.01)

(58) Field of Classification Search
CPC ..... G08B 13/1968; G08B 13/19695; G08B 13/22; G08B 29/22; G08B 26/00; H04L 63/102; H04L 67/2819; H04L 63/02; H04L 63/0263; H04L 63/0281; H04L 63/1416; H04L 63/1425; H04L 63/1433; H04L 63/20; H04M 1/67; H04M 1/72406; H04M 1/72451; H04M 1/72457; H04M 1/72463; H04W 12/06; H04W 12/08; H04W 12/37; H04W 12/63; H04W 12/73; H04W 48/04; H04W 4/021; H04W 84/12; H04W 8/205; G06F 16/245; G06F 21/554; G06F 8/65; H04N 7/18
USPC ..... 340/501, 541, 565–566, 550, 552–553, 340/517, 521, 531, 561, 539.1, 506, 340/539.13, 545.1, 10.1
See application file for complete search history.

(56) References Cited

U.S. PATENT DOCUMENTS

| | | | | |
|---|---|---|---|---|
| 9,800,570 | B1 * | 10/2017 | Bleisch | H04W 12/082 |
| 10,748,411 | B2 * | 8/2020 | Lifshitz | G08B 13/26 |
| 2003/0003900 | A1 | 1/2003 | Goss et al. | |
| 2003/0156030 | A1 * | 8/2003 | Lee | G08B 25/008 340/541 |
| 2004/0090327 | A1 * | 5/2004 | Soloway | G08B 13/08 340/545.1 |
| 2008/0079561 | A1 | 4/2008 | Trundle | |
| 2014/0159883 | A1 | 6/2014 | Damiani | |
| 2014/0266699 | A1 * | 9/2014 | Poder | G08B 25/008 340/539.13 |
| 2015/0254972 | A1 | 9/2015 | Patterson et al. | |
| 2016/0133120 | A1 * | 5/2016 | Reibel | G08B 25/008 340/506 |
| 2017/0018167 | A1 | 1/2017 | Dey et al. | |
| 2017/0084143 | A1 | 3/2017 | Acera et al. | |
| 2017/0090441 | A1 | 3/2017 | Schmitt | |
| 2017/0098367 | A1 * | 4/2017 | M | G08B 25/10 |
| 2017/0352255 | A1 * | 12/2017 | Sweeney | G08B 25/008 |

OTHER PUBLICATIONS

Jul. 19, 2018 International Search Report and Written Opinion issued in International Patent Application No. PCT/IL2018/050553.

* cited by examiner

SYSTEM AND METHOD FOR AUTOMATICALLY DISARMING AN INTRUSION DETECTION SYSTEM

CROSS-REFERENCE TO RELATED APPLICATIONS

This application is a Continuation of U.S. patent application Ser. No. 16/418,594, titled "SYSTEM AND METHOD FOR AUTOMATICALLY DISARMING AN INTRUSION DETECTION SYSTEM," filed May 21, 2019, which is a continuation of U.S. patent application Ser. No. 15/920,666, titled "SYSTEM AND METHOD FOR AUTOMATICALLY DISARMING AN INTRUSION DETECTION SYSTEM," filed on Mar. 14, 2018, now U.S. Pat. No. 10,347,116 issued on Jul. 9, 2019, which claims priority to U.S. Provisional Patent Application No. 62/506,804, filed on May 16, 2017, the entirety of all of which are incorporated herein by reference.

FIELD OF THE INVENTION

The present invention relates generally to automatic disarming of intrusion detection systems.

BACKGROUND OF THE INVENTION

Commercially available intrusion detection systems are typically armed and disarmed by an authorized operator having physical access to a control panel of the intrusion detection system. Such systems are prone to generating false intrusion detection alarms in cases where an authorized operator of the intrusion detection system accesses the premises protected by the intrusion detection system while the system is in an armed state of operation, while neglecting to first manually disarm the intrusion detection system. The present invention provides a method and system for automatically disarming an intrusion detection system.

SUMMARY OF THE INVENTION

The present invention seeks to provide a system and method for automatically disarming an intrusion detection system.

There is thus provided in accordance with a preferred embodiment of the present invention a system for automatically disarming an intrusion detection system, the intrusion detection system protecting a premises and having at least an armed state of operation and a disarmed state of operation, the system for automatically disarming the intrusion detection system including an intrusion detection system state of operation ascertainer operable, responsive to receiving an indication of detection of an intrusion to the premises, for ascertaining whether the intrusion detection system is in the armed state of operation; a registered mobile communicator proximity detector communicating with the intrusion detection system state of operation ascertainer and operable, responsive to ascertaining that the intrusion detection system is in the armed state of operation, for ascertaining whether at least one of a multiplicity of mobile communicators registered with the registered mobile communicator proximity detector is in a vicinity of the premises; and an automatic intrusion detection system disarmer communicating with the registered mobile communicator proximity detector and operable, responsive to ascertaining that at least one of the multiplicity of mobile communicators registered with the registered mobile communicator proximity detector is in the vicinity of the premises, for automatically disarming the intrusion detection system.

Preferably, the registered mobile communicator proximity detector is also operable, responsive to ascertaining that none of the multiplicity of mobile communicators registered with the intrusion detection system are in the vicinity of the premises, for generating an intrusion indication indicative of the intrusion.

Preferably, the intrusion is detected by at least one sensor of the intrusion detection system.

Preferably, ascertaining whether the intrusion detection system is in the armed state of operation by the intrusion detection system state of operation ascertainer includes communicating, by the intrusion detection system state of operation ascertainer to the intrusion detection system, a query for the state of operation of the intrusion detection system and, responsive to receiving the query for the state of operation of the intrusion detection system from the intrusion detection system state of operation ascertainer, communicating by the intrusion detection system to the intrusion detection system state of operation ascertainer, the state of operation of the intrusion detection system. Additionally or alternatively, the intrusion detection system state of operation ascertainer is also operable for automatically receiving indications of changes in the state of operation of the intrusion detection system from the intrusion detection system.

Preferably, communicating between the intrusion detection system state of operation ascertainer and the intrusion detection system includes communicating over the powerG communication protocol.

Preferably, the multiplicity of mobile communicators registered with the registered mobile communicator proximity detector are registered with the registered mobile communicator proximity detector via Bluetooth Low Energy (BLE) bonding with the registered mobile communicator proximity detector. Preferably, ascertaining, by the registered mobile communicator proximity detector, whether the at least one of the multiplicity of mobile communicators registered with the registered mobile communicator proximity detector is in a vicinity of the premises includes employing, by the registered mobile communicator proximity detector, the Bluetooth Low Energy (BLE) communication protocol to scan the vicinity of the premises for the at least one of the multiplicity of mobile communicators registered with the registered mobile communicator proximity detector.

Preferably, automatically disarming the intrusion detection system by the automatic intrusion detection system disarmer includes establishing a Bluetooth Low Energy (BLE) connection between the automatic intrusion detection system disarmer and the at least one registered mobile communicator; communicating, by the automatic intrusion detection system disarmer to the at least one registered mobile communicator, over the Bluetooth Low Energy (BLE) connection, an indication that the intrusion detection system is in the armed state of operation; responsive to receiving the indication that the intrusion detection system is in the armed state of operation, communicating, by the at least one registered mobile communicator to the automatic intrusion detection system disarmer, over the Bluetooth Low Energy (BLE) connection, an instruction to disarm the intrusion detection system; and, responsive to receiving the instruction to disarm the intrusion detection system by the automatic intrusion detection system disarmer, forwarding, by the automatic intrusion detection system disarmer to the intrusion detection system, over the powerG protocol, the instruction to disarm the intrusion detection system.

Preferably, automatically disarming the intrusion detection system by the automatic intrusion detection system disarmer further includes responsive to receiving, by the intrusion detection system, the instruction to disarm the intrusion detection system, disarming the intrusion detection system by the intrusion detection system; responsive to disarming the intrusion detection system by the intrusion detection system, communicating, by the intrusion detection system to the automatic intrusion detection system disarmer, over the powerG protocol, an indication of the disarming of the intrusion detection system by the intrusion detection system; and forwarding, by the automatic intrusion detection system disarmer to the at least one registered mobile communicator, over the Bluetooth Low Energy (BLE) connection, the indication of the disarming of the intrusion detection system by the intrusion detection system.

Preferably, the at least one sensor of the intrusion detection system includes a door contact sensor of the intrusion detection system.

There is also provided in accordance with another preferred embodiment of the present invention a method for automatically disarming an intrusion detection system protecting a premises, the method including receiving an indication of detection of an intrusion to said premises, responsive to receiving the indication of detection of the intrusion to the premises, ascertaining whether the intrusion detection system is in an armed state of operation; responsive to ascertaining that the intrusion detection system is in the armed state of operation, ascertaining whether at least one of a multiplicity of registered mobile communicators is in a vicinity of the premises; and, responsive to ascertaining that at least one of the multiplicity of registered mobile communicators is in the vicinity of the premises, automatically disarming the intrusion detection system.

Preferably, the method also includes, responsive to ascertaining that none of the multiplicity of registered mobile communicators are in the vicinity of the premises, generating an intrusion indication indicative of the intrusion.

Preferably, ascertaining whether the intrusion detection system is in the armed state of operation includes communicating, to the intrusion detection system, a query for the state of operation of the intrusion detection system, responsive to receiving, by the intrusion detection system, the query for the state of operation of the intrusion detection system, communicating by the intrusion detection system, the state of operation of the intrusion detection system, and receiving the state of operation of the intrusion detection system communicated by the intrusion detection system. Additionally or alternatively, the method also includes automatically receiving indications of changes in the state of operation of the intrusion detection system from the intrusion detection system.

Preferably, communicating to the intrusion detection system includes communicating over the powerG communication protocol.

Preferably, the multiplicity of registered mobile communicators are registered via Bluetooth Low Energy (BLE) bonding. Preferably, ascertaining whether the at least one of the multiplicity of registered mobile communicators is in a vicinity of the premises includes employing the Bluetooth Low Energy (BLE) communication protocol to scan the vicinity of the premises for the at least one of the multiplicity of registered mobile communicators.

Preferably, automatically disarming the intrusion detection system includes establishing a Bluetooth Low Energy (BLE) connection with the at least one registered mobile communicator; communicating to the at least registered mobile communicator, over the Bluetooth Low Energy (BLE) connection, an indication that the intrusion detection system is in the armed state of operation; responsive to receiving the indication that the intrusion detection system is in the armed state of operation, communicating, by the at least one registered mobile communicator, over the Bluetooth Low Energy (BLE) connection, an instruction to disarm the intrusion detection system; and, responsive to receiving the instruction to disarm the intrusion detection system, forwarding, to the intrusion detection system, over the powerG protocol, the instruction to disarm the intrusion detection system.

Preferably, automatically disarming the intrusion detection system further includes responsive to receiving, by the intrusion detection system, the instruction to disarm the intrusion detection system, disarming the intrusion detection system; responsive to disarming the intrusion detection system, communicating, by the intrusion detection system, over the powerG protocol, an indication of the disarming of the intrusion detection system; and forwarding, to the at least one registered mobile communicator, over the Bluetooth Low Energy (BLE) connection, the indication of the disarming of the intrusion detection system.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
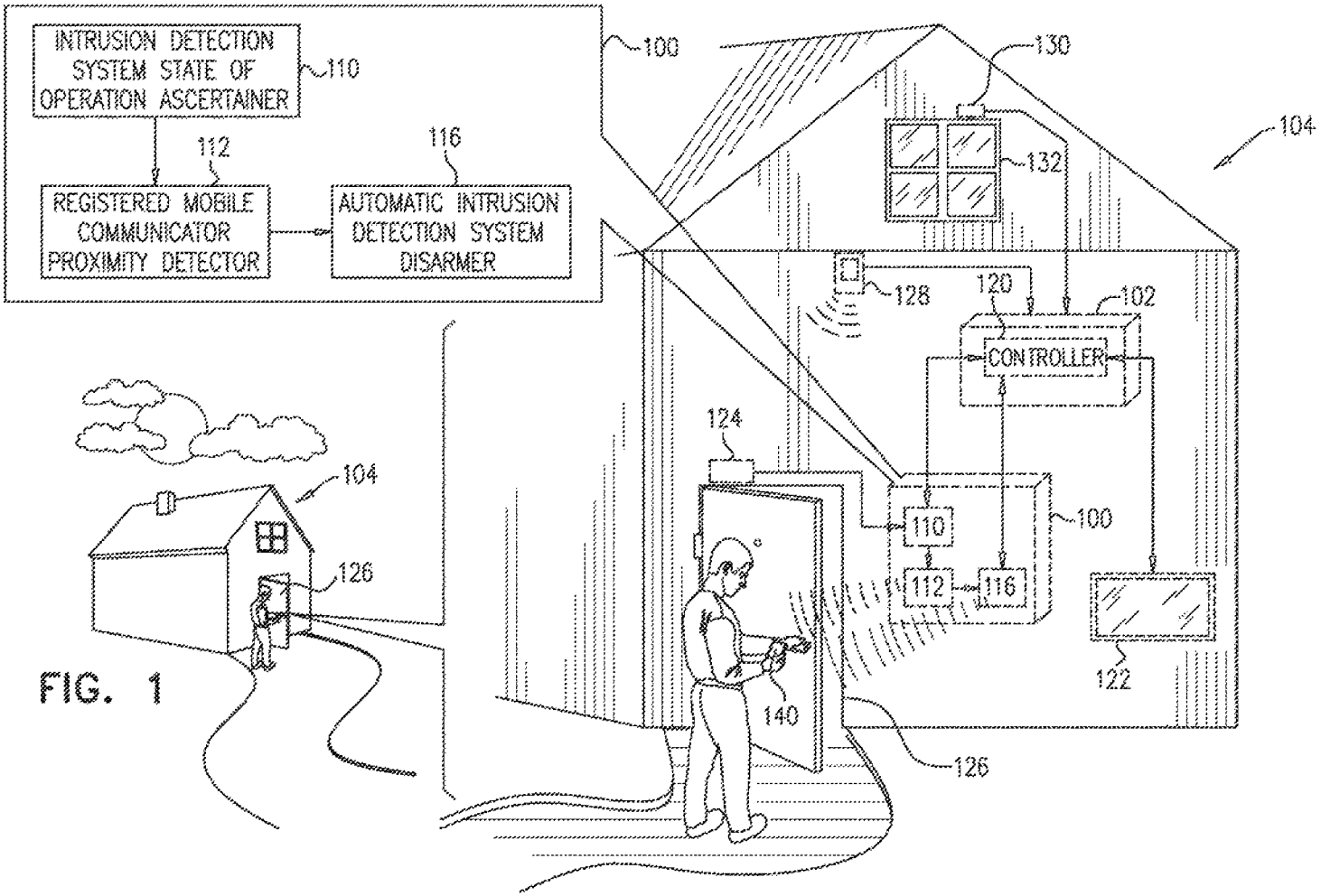
FIG. 1 is a simplified illustration of the operation of an automatic intrusion system disarming system, constructed and operative in accordance with a preferred embodiment of the present invention.

Reference is now made to FIG. 1, which is a simplified illustration of an automatic intrusion system disarming system, constructed and operative in accordance with a preferred embodiment of the present invention.

As shown in FIG. 1, there is provided an automatic intrusion system disarming system 100 operable for automatically disarming an intrusion detection system 102 protecting a premises 104, intrusion detection system 102 preferably having an armed state of operation and a disarmed state of operation. It is appreciated that communication between automatic intrusion system disarming system 100 and intrusion detection system 102 may be wired. Alternatively, to obviate the need for wired connection between automatic intrusion system disarming system 100 and intrusion detection system 102, automatic intrusion system disarming system 100 may be battery operated and therefore may employ a power-efficient wireless communication protocol when communicating with intrusion detection system 102 such as, for example, the powerG protocol.

Automatic intrusion system disarming system 100 preferably includes an intrusion detection system state of operation ascertainer 110 operable, responsive to detection of an intrusion to premises 104 by intrusion detection system 102, for ascertaining whether intrusion detection system 102 is in an armed state of operation.

Automatic intrusion system disarming system 100 also preferably includes a registered mobile communicator proximity detector 112 communicating with intrusion detection system state of operation ascertainer 110 and operable, responsive to ascertaining, by intrusion detection system state of operation ascertainer 110, that intrusion detection system 100 is in the armed state of operation, for ascertaining whether at least one of a multiplicity of mobile communicators registered with registered mobile communicator proximity detector 112 is in a vicinity of premises 104.

Automatic intrusion system disarming system 100 yet further preferably includes an automatic intrusion detection system disarmer 116 communicating with registered mobile communicator proximity detector 112 and operable, responsive to ascertaining, by registered mobile communicator proximity detector 112 that at least one of the multiplicity of mobile communicators registered with registered mobile communicator proximity detector 112 is in the vicinity of the premises, for automatically disarming intrusion detection system 100.

Intrusion detection system 102 typically includes a controller 120 operable for controlling intrusion detection system 102. Controller 120 may, for example, be manually accessible to an operator via a user interface 122 or remotely accessible such as by employing a suitable communicator device such as a mobile telephone. Controller 120 is preferably operable for communicating with intrusion detection system state of operation ascertainer 110 and with automatic intrusion detection system disarmer 116.

It is appreciated that controller 120 is preferably operable, responsive to receiving a suitable instruction, for switching the state of operation of intrusion detection system 102 between an armed state of operation and a disarmed state of operation. It is appreciated that such a suitable instruction may be received, for example, by controller 120 from automatic intrusion detection system disarmer 116. Controller 120 is also preferably operable for providing an indication of a current state of operation of intrusion detection system 102. For example, controller 120 may provide an indication of a current state of operation of intrusion detection system 102 to intrusion detection system state of operation ascertainer 110.

Intrusion detection system 102 also typically includes a multiplicity of sensors operable for detecting intrusions to various parts of premises 104. These sensors may include, for example, a magnetic contact sensor 124 mounted on a front door 126 of premises 104, operable for detecting opening of front door 126. Additional sensors may include, for example, motion sensors 128 operable for detecting motion inside premises 104 or in the vicinity of premises 104 and a contact sensor 130 mounted on a window 132 of premises 104 operable for detecting opening of window 132.

As illustrated in FIG. 1, an individual approaches front door 126 of premises 104 and opens front door 126. As described hereinabove, the opening of front door 126 is preferably detected by sensor 124 mounted on front door 126. It is appreciated the individual opening door 126 may or may not be authorized to access premises 104.

Responsive to detecting opening of front door 126, sensor 124 preferably communicates an intrusion detection indication to intrusion detection system state of operation ascertainer 110 of automatic intrusion system disarming system 100, operable for ascertaining whether intrusion detection system 102 is in the armed state of operation. It is appreciated that communication between sensor 124 and automatic intrusion system disarming system 100 may be wired. Alternatively, to obviate the need for wired connection between sensor 110 and automatic intrusion system disarming system 100, sensor 124 may be battery operated and therefore preferably may employ a power-efficient wireless communication protocol when communicating with automatic intrusion system disarming system 100 such as, for example, the powerG protocol.

Responsive to receiving the intrusion detection indication, intrusion detection system state of operation ascertainer 110 of automatic intrusion system disarming system 100 preferably communicates to controller 120 of intrusion detection system 102, a query for the state of operation of intrusion detection system 102. As described hereinabove, it is appreciated that communication between intrusion detection system state of operation ascertainer 110 of automatic intrusion system disarming system 100 and controller 120 of intrusion detection system 102 may be wired. Alternatively, to obviate the need for wired connection between intrusion detection system state of operation ascertainer 110 of automatic intrusion system disarming system 100 and controller 120 of intrusion detection system 102, automatic intrusion system disarming system 100 may be battery operated and therefore may employ a power-efficient wireless communication protocol when communicating with intrusion detection system 102 such as, for example, the powerG protocol.

Responsive to receiving the query for the state of operation of intrusion detection system 102 from intrusion detection system state of operation ascertainer 110, controller 120 preferably communicates to intrusion detection system state of operation ascertainer 110 the state of operation of intrusion detection system 102. It is appreciated that, alternatively, controller 120 may automatically notify intrusion detection system state of operation ascertainer 110 of changes in the state of operation of intrusion detection system 102 as they occur, thereby obviating the need for intrusion detection system state of operation ascertainer 110 to query controller 120 for the state of operation of intrusion detection system 102 in response to receiving an intrusion detection indication.

In a case where intrusion detection system 102 is in the disarmed state of operation, intrusion detection system state of operation ascertainer 110 preferably ignores the intrusion detection indication of the opening of front door 126.

In a case where intrusion detection system 102 is in the armed state of operation, intrusion detection system state of operation ascertainer 110 preferably communicates the intrusion detection indication of the opening of front door 126 and an indication of the armed state of operation of intrusion detection system 102 to registered mobile communicator proximity detector 112. Responsive thereto, registered mobile communicator proximity detector 112 preferably ascertains whether at least one of a multiplicity of mobile communicators registered with registered mobile communicator proximity detector 112 is in a vicinity of premises 104.

It is appreciated that mobile communicators, such as mobile telephone devices, of individuals authorized to access premises 104 are preferably pre-registered with registered mobile communicator proximity detector 112, for example, via Bluetooth Low Energy (BLE) bonding with registered mobile communicator proximity detector 112. Accordingly, ascertaining, by registered mobile communicator proximity detector 112, whether at least one of a multiplicity of mobile communicators registered with registered mobile communicator proximity detector 112 is in a vicinity of premises 104, preferably includes employing the Bluetooth Low Energy (BLE) wireless communication protocol to scan the vicinity of premises 104 for the presence of a mobile communicator registered with registered mobile communicator proximity detector 112.

Responsive to ascertaining that a mobile communicator 140 registered with registered mobile communicator proximity detector 112 is in the vicinity of premises 104 and that intrusion detection system 102 is in the armed state of operation, registered mobile communicator proximity detector 112 preferably communicates, to automatic intrusion detection system disarmer 116, an instruction to automatically disarm intrusion detection system 102.

To automatically disarm intrusion detection system 102, automatic intrusion detection system disarmer 116 preferably establishes a Bluetooth Low Energy (BLE) wireless connection with mobile communicator 140, and communicates to mobile communicator 140 an indication that intrusion detection system 102 is in the armed state of operation. Responsive to receiving the indication that intrusion detection system 102 is in the armed state of operation, mobile communicator 140 preferably wirelessly communicates to automatic intrusion detection system disarmer 116, over the Bluetooth Low Energy (BLE) wireless connection, an instruction to disarm intrusion detection system 102. Responsive to receiving the instruction to disarm intrusion detection system 102, automatic intrusion detection system disarmer 116 preferably forwards to controller 120, over the powerG wireless communication protocol, the instruction to disarm intrusion detection system 102.

Responsive to receiving, by controller 120, the instruction to disarm intrusion detection system 102, controller 120 preferably proceeds to disarm intrusion detection system 102. Responsive to the disarming of intrusion detection system 102 by controller 120, controller 120 preferably communicates to automatic intrusion detection system disarmer 116, over the powerG wireless communication protocol, an indication of the disarming of intrusion detection system 102 by controller 120. Responsive to receiving the indication of the disarming of intrusion detection system 102 by controller 120, automatic intrusion detection system disarmer 116 preferably communicates to mobile communicator 140, over the Bluetooth Low Energy (BLE) wireless connection, the indication of the disarming of intrusion detection system 102 by controller 120.

It is appreciated that responsive to ascertaining that none of the multiplicity of mobile communicators registered with intrusion detection system 102 are in the vicinity of premises 104, registered mobile communicator proximity detector 112 is preferably operable for generating an intrusion indication indicative of an intrusion, and for communicating the intrusion indication to controller 120. Controller 120 then, in turn, may generate an alarm indication which, for example, is communicated to an operator of intrusion detection system 102.

It is appreciated that automatic intrusion system disarming system 100 may be embedded in sensor 124, which is typically battery-powered. It is therefore imperative for automatic intrusion system disarming system 100 to employ power efficient methods of communication. It is therefore a particular feature of the present invention that automatic intrusion system disarming system 100 preferably communicates with controller 120 over a power-efficient wireless communication protocol such as, for example, the powerG protocol. It is further appreciated, however, that commercially available mobile communicators are typically incapable of communicating over the powerG protocol. Therefore, in the interest of power efficiency, registered mobile communicator proximity detector 112 is preferably operable to scan the vicinity of premises 104 for the presence of a mobile communicator registered with registered mobile communicator proximity detector 112 and to communicate with a registered mobile communicator over the Bluetooth Low Energy (BLE) wireless communication protocol only in response to detecting opening of door 126 and to ascertaining that intrusion detection system 102 is in the armed state of operation.

Figure 2A:
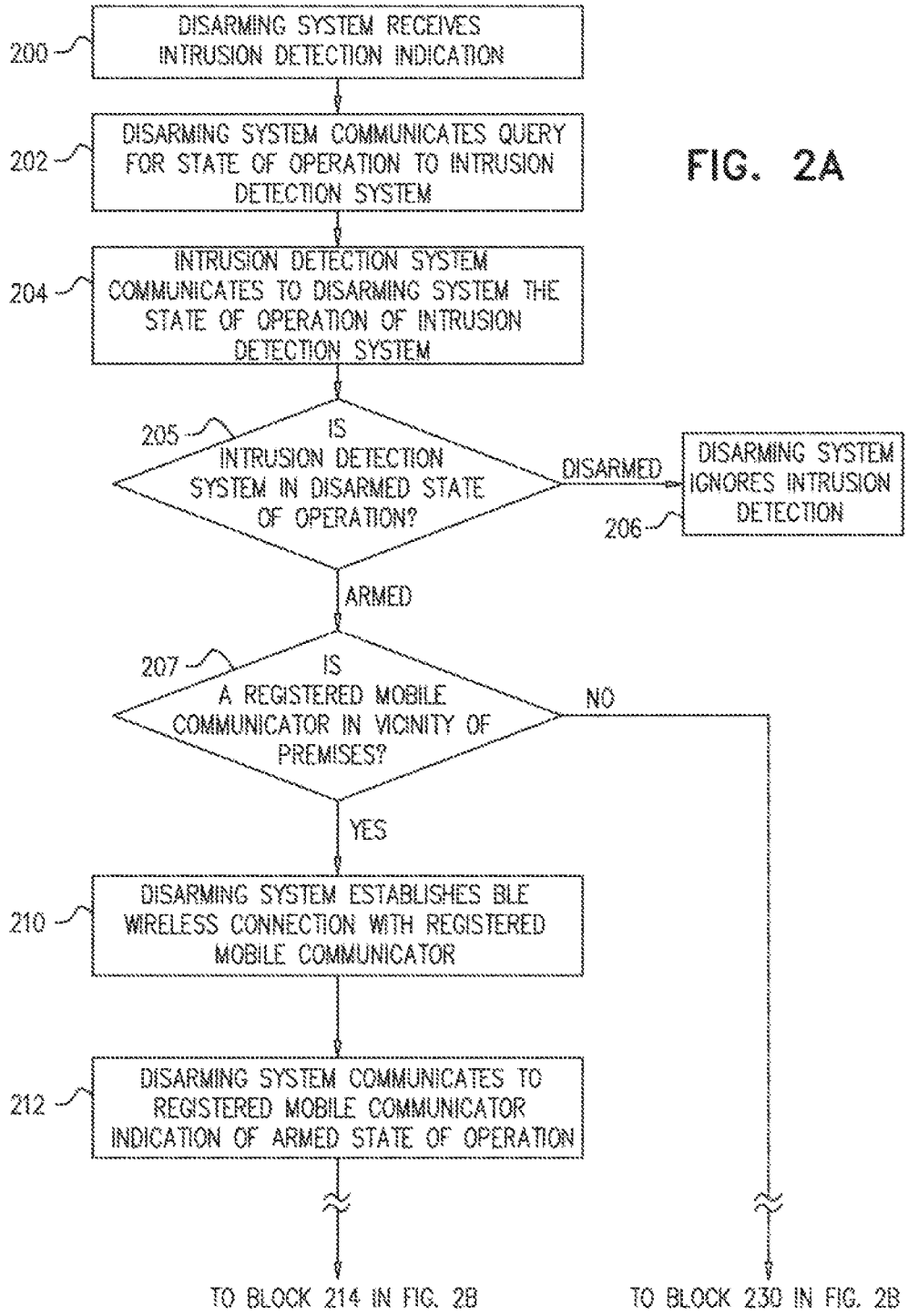
FIGS. 2A and 2B are together a simplified flowchart indicating steps in the operation of the automatic intrusion system disarming system of FIG. 1.
Figure 2B:
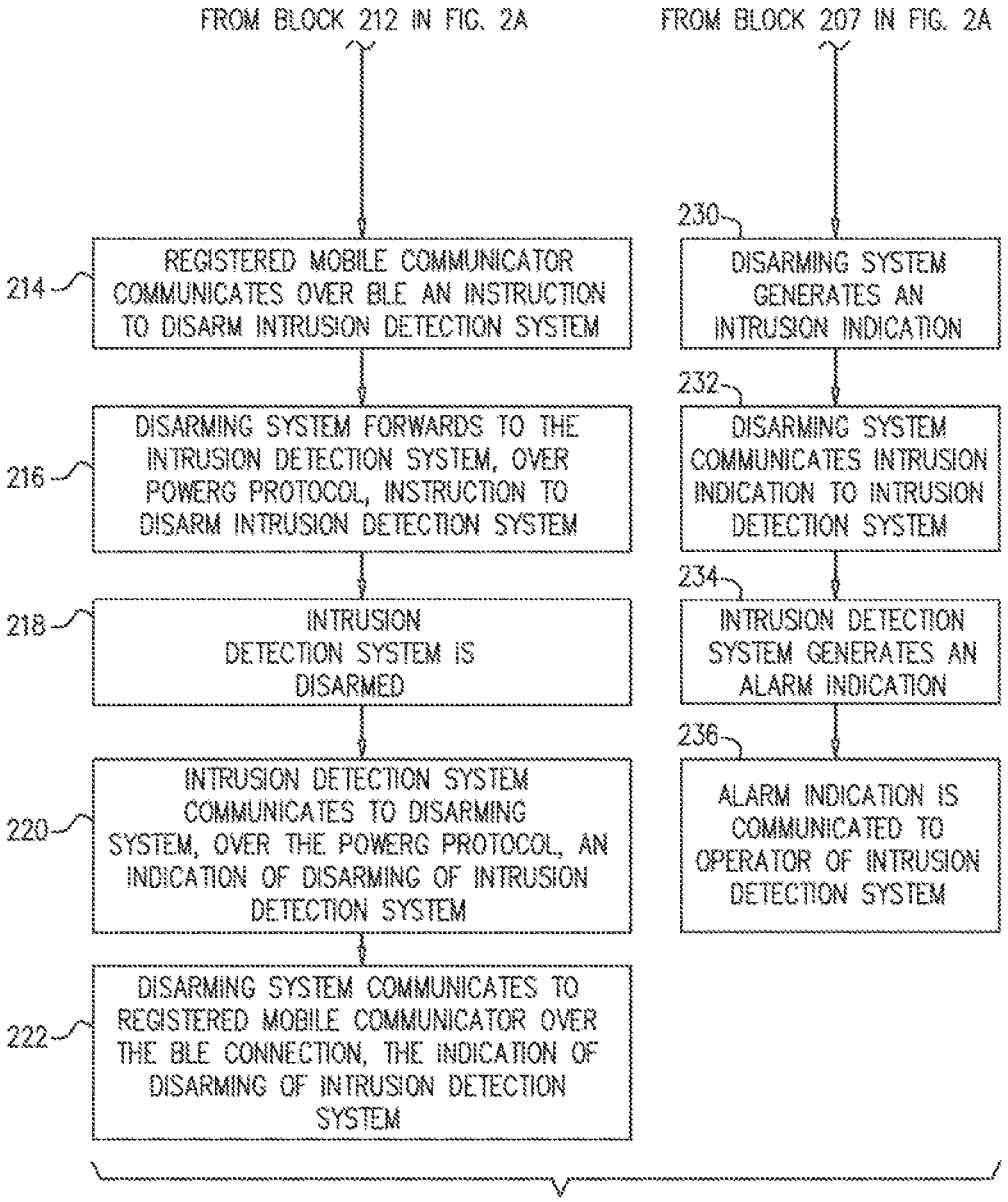

Reference is now made to FIGS. 2A and 2B, which are together a simplified flowchart indicating steps in the operation of the automatic intrusion system disarming system of FIG. 1. As described hereinabove with reference to FIG. 1, the automatic intrusion system disarming system is preferably operable for automatically disarming an intrusion detection system protecting a premises, the intrusion detection system preferably having an armed state of operation and a disarmed state of operation.

As shown in FIG. 2A, the automatic intrusion system disarming system initially receives an indication of detection of an intrusion to said premises from said intrusion detection system, such as opening of the front door of the premises (200). It is appreciated that the intrusion is preferably detected by at least one sensor of the intrusion detection system. The sensor may be, for example, a door contact sensor mounted on the front door.

Responsive to receiving the intrusion detection indication, the automatic intrusion system disarming system preferably ascertains whether the intrusion detection system is in an armed state of operation by communicating to the intrusion detection system, a query for the state of operation of the intrusion detection system (202). It is appreciated that to obviate the need for wired connection between the automatic intrusion system disarming system and the intrusion detection system, the automatic intrusion system disarming system is typically battery operated and therefore preferably employs a power-efficient wireless communication protocol when communicating with the intrusion detection system such as, for example, the powerG protocol.

Responsive to receiving the query for the state of operation of the intrusion detection system from the automatic intrusion system disarming system, the intrusion detection system preferably communicates to the automatic intrusion system disarming system the state of operation of the intrusion detection system (204). It is appreciated that, alternatively, the intrusion detection system may automatically notify the automatic intrusion system disarming system of changes in the state of operation of the intrusion detection system as they occur, thereby obviating the need for the automatic intrusion system disarming system to query the intrusion detection system for the state of operation of the intrusion detection system in response to receiving an intrusion detection indication.

Responsive to ascertaining that the intrusion detection system is in the disarmed state of operation (205), the automatic intrusion system disarming system preferably ignores the detection of opening of the front door (206).

Responsive to ascertaining that the intrusion detection system is in the armed state of operation, the automatic intrusion system disarming system preferably ascertains whether at least one of a multiplicity of registered mobile communicators is in a vicinity of the premises (207). It is appreciated that mobile communicators of individuals authorized to access the premises are preferably pre-registered with the automatic intrusion system disarming system, for example, via Bluetooth Low Energy (BLE) bonding with the automatic intrusion system disarming system. Accordingly, ascertaining, by the automatic intrusion system disarming system, whether at least one of a multiplicity of registered mobile communicators is in a vicinity of the premises preferably includes employing the Bluetooth Low Energy (BLE) wireless communication protocol to scan the vicinity of the premises for the presence of a registered mobile communicator.

Responsive to ascertaining that at least one registered mobile communicator is in the vicinity of the premises, the automatic intrusion system disarming system preferably automatically disarms the intrusion detection system as follows:

Initially, the automatic intrusion system disarming system establishes a Bluetooth Low Energy (BLE) wireless connection with the registered mobile communicator (210). Thereafter, the automatic intrusion system disarming system preferably communicates to the registered mobile communicator, an indication that the intrusion detection system is in the armed state of operation (212).

Turning now to FIG. 2B, it is shown that responsive to receiving the indication that the intrusion detection system is in the armed state of operation, the registered mobile communicator preferably communicates to the automatic intrusion system disarming system, over the Bluetooth Low Energy (BLE) connection, an instruction to disarm the intrusion detection system (214). Responsive to receiving the instruction to disarm the intrusion detection system, the automatic intrusion system disarming system preferably forwards to the intrusion detection system, over the powerG protocol, the instruction to disarm the intrusion detection system (216).

Responsive to receiving, by the intrusion detection system, the instruction to disarm the intrusion detection system, the intrusion detection system is disarmed (218). Responsive to disarming of the intrusion detection system, the intrusion detection system preferably communicates to the automatic intrusion system disarming system, over the powerG protocol, an indication of the disarming of the intrusion detection system (220). Thereafter, the automatic intrusion system disarming system preferably communicates to the registered mobile communicator over the Bluetooth Low Energy (BLE) connection, the indication of the disarming of the intrusion detection system (222).

Responsive to ascertaining that none of the multiplicity of mobile communicators registered with the intrusion detection system are in the vicinity of the premises, the automatic intrusion system disarming system preferably generates an intrusion indication indicative of an intrusion (230), and preferably communicates the intrusion indication to the intrusion detection system (232). The intrusion detection system then, in turn, may generate an alarm indication (234) which, for example, is then communicated to an operator of the intrusion detection system (236).

It will be appreciated by persons skilled in the art that the present invention is not limited by what has been particularly shown and described hereinabove. Rather the scope of the present invention includes both combinations and subcombinations of the various features described hereinabove as well as modifications thereof which would occur to persons skilled in the art upon reading the foregoing description and which are not in the prior art.

The invention claimed is:

1. A system for automatically disarming an intrusion detection system that is configured to protect a premises and is switchable between an armed state of operation and a disarmed state of operation, the system comprising:

an intrusion detection system state of operation ascertainer operable, responsive to receiving an indication of an intrusion to the premises, for ascertaining whether the intrusion detection system of the premises is in the armed state of operation;

a registered mobile communicator proximity detector operable, responsive to (A) the indication of the intrusion to the premises and (B) the intrusion detection system being in the armed state of operation, for ascertaining whether at least one mobile communicator that is registered with the registered mobile communicator proximity detector is in a vicinity of the premises; and an automatic intrusion detection system disarmer operable, responsive to (A) the indication of the intrusion to the premises, (B) the intrusion detection system being in the armed state of operation, and (C) the at least one mobile communicator being in the vicinity of the premises, for disarming the intrusion detection system by switching the intrusion detection system from the armed state of operation to the disarmed state of operation.

2. The system of claim 1, wherein the registered mobile communicator proximity detector is also operable, responsive to no registered mobile communicators being in the vicinity of the premises, for generating an intrusion indication indicative of the intrusion.

3. The system of claim 1, wherein the intrusion is detected by at least one sensor of the intrusion detection system.

4. The system of claim 3, wherein the at least one sensor of the intrusion detection system comprises a door contact sensor.

5. The system of claim 1, wherein the intrusion detection system state of operation ascertainer is operable for ascertaining whether the intrusion detection system is in the armed state of operation by:

communicating, to the intrusion detection system, a query for a state of operation of the intrusion detection system; and receiving, from the intrusion detection system, responsive to the query, the state of operation of the intrusion detection system.

6. The system of claim 5, wherein the intrusion detection system state of operation ascertainer is operable for communicating with the intrusion detection system over a powerG communication protocol.

7. The system of claim 1, wherein the intrusion detection system state of operation ascertainer is further operable for receiving indications of changes in a state of operation of the intrusion detection system from the intrusion detection system.

8. The system of claim 1, wherein the at least one mobile communicator is registered with the registered mobile communicator proximity detector via Bluetooth Low Energy (BLE) bonding with the registered mobile communicator proximity detector.

9. The system of claim 1, wherein the registered mobile communicator proximity detector is operable for ascertaining whether the at least one mobile communicator is in the vicinity of the premises by employing the Bluetooth Low Energy (BLE) communication protocol to scan the vicinity of the premises for the at least one mobile communicator.

10. The system of claim 1, wherein the automatic intrusion detection system disarmer is operable for disarming the intrusion detection system by:

establishing a Bluetooth Low Energy (BLE) connection with the at least one mobile communicator;

communicating, to the at least one mobile communicator, over the BLE connection, a first indication indicating that the intrusion detection system is in the armed state of operation;

receiving, from the at least one mobile communicator, responsive to the first indication, over the BLE connection, an instruction to disarm the intrusion detection system; and forwarding, to the intrusion detection system, the instruction to disarm the intrusion detection system, over a powerG protocol.

11. The system of claim 10, wherein the automatic intrusion detection system disarmer is further operable for disarming the intrusion detection system by:

receiving, from the intrusion detection system, over the powerG protocol, a second indication of the intrusion detection system being disarmed responsive to the instruction; and forwarding, to the at least one mobile communicator, over the BLE connection, the second indication of the intrusion detection system being disarmed.

12. A method for automatically disarming an intrusion detection system that is configured to protect a premises and is switchable between an armed state of operation and a disarmed state of operation, the method comprising:

receiving an indication of an intrusion to the premises;

determining, responsive to receiving the indication, whether an intrusion detection system of the premises is in an armed state of operation;

determining, by a registered mobile communicator proximity detector, responsive to (A) the indication of the intrusion to the premises and (B) the intrusion detection system being in the armed state of operation, whether at least one mobile communicator that is registered with the registered mobile communicator proximity detector is in a vicinity of the premises; and disarming the intrusion detection system responsive to (A) the indication of the intrusion to the premises, (B) the intrusion detection system being in the armed state of operation, and (C) the at least one mobile communicator being in the vicinity of the premises by switching the intrusion detection system from the armed state of operation to the disarmed state of operation.

13. The method of claim 12, further comprising generating an intrusion indication indicative of the intrusion, responsive to no registered mobile communicators being in the vicinity of the premises.

14. The method of claim 12, wherein determining whether the intrusion detection system is in the armed state of operation comprises:

communicating, to the intrusion detection system, a query for a state of operation of the intrusion detection system; and receiving, from the intrusion detection system, responsive to the query, the state of operation of the intrusion detection system.

15. The method of claim 14, wherein communicating the query to the intrusion detection system comprises communicating over a powerG communication protocol.

16. The method of claim 12, further comprising receiving indications of changes in a state of operation of the intrusion detection system from the intrusion detection system.

17. The method of claim 12, wherein the at least one mobile communicator is registered via Bluetooth Low Energy (BLE) bonding.

18. The method of claim 12, wherein determining whether the at least one mobile communicator is in the vicinity of the premises comprises employing a Bluetooth Low Energy (BLE) communication protocol to scan the vicinity of the premises for the at least one mobile communicator.

19. The method of claim 12, wherein disarming the intrusion detection system comprises:

establishing a Bluetooth Low Energy (BLE) connection with the at least one mobile communicator;

communicating, to the at least one mobile communicator, over the BLE connection, a first indication that the intrusion detection system is in the armed state of operation;

receiving, from the at least one mobile communicator, responsive to the first indication, over the BLE connection, an instruction to disarm the intrusion detection system; and forwarding, to the intrusion detection system, the instruction to disarm the intrusion detection system over a powerG protocol.

20. The method of claim 19, wherein disarming the intrusion detection system further comprises:

receiving, from the intrusion detection system, over the powerG protocol, a second indication of the intrusion detection system being disarmed responsive to the instruction to disarm the intrusion detection system; and forwarding, to the at least one mobile communicator over the BLE connection, the second indication of the intrusion detection system being disarmed.

* * * * *